US009366160B2

(12) United States Patent
Morehead et al.

(10) Patent No.: US 9,366,160 B2
(45) **Date of Patent: *Jun. 14, 2016**

(54) CENTERING SLOT FOR INTERNAL COMBUSTION ENGINE

(71) Applicant: Hilite Germany GmbH, Marktheidenfeld (DE)

(72) Inventors: James Anthony Morehead, Mocksville, NC (US); Wes Gerszewski, Coppell, TX (US); John Snyder, Irving, TX (US); Joe S. Cole, Mesquite, TX (US); Jack Doyle Hutcheson, Garland, TX (US); Steve Nance, Highland Village, TX (US)

(73) Assignee: Hilite Germany GMBH (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/632,041

(22) Filed: Feb. 26, 2015

(65) Prior Publication Data

US 2015/0167505 A1 Jun. 18, 2015

Related U.S. Application Data

(63) Continuation of application No. 13/624,196, filed on Sep. 21, 2012, now Pat. No. 8,973,542.

(51) Int. Cl.
*F01L 1/34* (2006.01)
*F01L 1/344* (2006.01)

(52) U.S. Cl.
CPC ..... *F01L 1/34* (2013.01); *F01L 1/3442* (2013.01); *F01L 2001/34426* (2013.01); *F01L 2001/34456* (2013.01); *F01L 2001/34463* (2013.01); *F01L 2001/34469* (2013.01); *F01L 2250/02* (2013.01); *F01L 2250/04* (2013.01)

(58) Field of Classification Search
CPC . F01L 1/34; F01L 1/3442; F01L 2001/34456; F01L 2001/34469; F01L 2250/04; F01L 2001/34426; F01L 2001/34463; F01L 2250/02
USPC ..... 123/90.17
See application file for complete search history.

(56) References Cited

U.S. PATENT DOCUMENTS

| | | | |
|---|---|---|---|
| 5,497,738 | A | 3/1996 | Siemon et al. |
| 5,901,674 | A | 5/1999 | Fujiwaki |
| 6,173,687 | B1 | 1/2001 | Fukuhara et al. |
| 6,263,846 | B1 | 7/2001 | Simpson et al. |
| 6,378,475 | B2 | 4/2002 | Takenaka et al. |

(Continued)

FOREIGN PATENT DOCUMENTS

| | | |
|---|---|---|
| EP | 2 282 020 | 2/2011 |
| EP | 2 412 944 | 2/2012 |

(Continued)

*Primary Examiner* — Zelalem Eshete
(74) *Attorney, Agent, or Firm* — Clark Hill PLC

(57) ABSTRACT

A valve timing control device for an internal combustion engine. The valve timing control device includes a rotor connected to a camshaft and having a plurality of vanes. A stator is engaged with the rotor, and includes a plurality of webs. Pressure chambers are provided between each of the webs and vanes. A centering slot is provided on the stator and/or the rotor. A pressure medium control valve is disposed in one of the vanes of the rotor, and is configured to not only selectively lock and unlock the position of the rotor relative to the stator, but is also configured such that pressure medium in the pressure chambers is ventable through the centering slot and thereafter through the pressure medium control valve.

20 Claims, 14 Drawing Sheets

(56) References Cited

U.S. PATENT DOCUMENTS

| | | | | |
|---|---|---|---|---|
| 6,386,164 | B1 | 5/2002 | Mikame et al. | |
| 6,439,184 | B1 | 8/2002 | Takenaka et al. | |
| 6,443,112 | B1 | 9/2002 | Kinugawa | |
| 6,460,496 | B2 | 10/2002 | Fukuhara et al. | |
| 6,477,996 | B2 | 11/2002 | Ogawa | |
| 6,481,402 | B1 | 11/2002 | Simpson et al. | |
| 6,668,778 | B1 | 12/2003 | Smith | |
| 6,684,835 | B2 | 2/2004 | Komazawa et al. | |
| 6,742,484 | B2 | 6/2004 | Sluka et al. | |
| 6,779,499 | B2 | 8/2004 | Takenaka et al. | |
| 6,779,500 | B2 | 8/2004 | Kanada et al. | |
| 6,820,578 | B2 | 11/2004 | Kanada et al. | |
| 6,880,505 | B2 | 4/2005 | Kinugawa et al. | |
| 6,883,481 | B2 | 4/2005 | Gardner et al. | |
| 6,945,205 | B2 | 9/2005 | Heintzen et al. | |
| 6,968,818 | B2 | 11/2005 | Plank et al. | |
| 6,976,460 | B2 | 12/2005 | Komazawa et al. | |
| 7,290,510 | B2 | 11/2007 | Takahashi et al. | |
| 7,931,000 | B2 | 4/2011 | Ushida et al. | |
| 8,033,257 | B2 | 10/2011 | Fischer | |
| 8,973,542 | B2 * | 3/2015 | Morehead | F01L 1/3442 123/90.17 |
| 2010/0186710 | A1 | 7/2010 | Persson et al. | |
| 2010/0199937 | A1 | 8/2010 | Fujiyoshi | |
| 2010/0204900 | A1 | 8/2010 | Gelez et al. | |
| 2010/0300388 | A1 | 12/2010 | Lang et al. | |
| 2010/0313835 | A1 | 12/2010 | Yamaguchi et al. | |
| 2011/0017156 | A1 | 1/2011 | Smith | |
| 2011/0035134 | A1 | 2/2011 | Urushihata | |
| 2011/0168111 | A1 | 7/2011 | Cowgill | |
| 2011/0232594 | A1 | 9/2011 | Miyachi et al. | |
| 2011/0315104 | A1 | 12/2011 | Imamura et al. | |
| 2012/0000437 | A1 | 1/2012 | Ozawa et al. | |

FOREIGN PATENT DOCUMENTS

| | | |
|---|---|---|
| JP | 2009-250073 | 10/2009 |
| JP | 2010-209780 | 9/2010 |
| JP | 2010-242531 | 10/2010 |
| JP | 2011-069287 | 4/2011 |
| JP | 2011-117317 | 6/2011 |
| JP | 2011-163270 | 8/2011 |
| JP | 2013-155612 | 8/2013 |
| WO | 2010/061936 | 6/2010 |
| WO | 2010/119322 | 10/2010 |
| WO | 2011/001702 | 1/2011 |

* cited by examiner

CENTERING SLOT FOR INTERNAL COMBUSTION ENGINE

RELATED APPLICATION

This application is a continuation of U.S. patent application Ser. No. 13/624,196, filed on Sep. 21, 2012, which is hereby incorporated herein by reference in its entirety.

BACKGROUND OF THE INVENTION

The present invention relates to a cam phases of an internal combustion engine, wherein a centering slot is provided which tends to, at certain times depending on the stage of operation of the internal combustion engine, center and lock the rotor relative to the stator.

A typical internal combustion engine provides that a crankshaft drives a drive wheel using a chain or drive belt. A stator is joined in a torsionally rigid manner to the drive wheel. As such, the stator is drive-connected to the crankshaft by means of this drive element and drive wheel.

A corresponding rotor is engaged with the stator, and is joined to the camshaft in a torsionally rigid manner. The camshaft has cam lobes thereon which push against gas exchange valves in order to open them. By rotating the camshaft, the opening and closing time points of the gas exchange valves are shifted so that the internal combustion engine offers its optimal performance at the speed involved.

To optimize performance during operation of the internal combustion engine, the angular position of the camshaft is continuously changed relative to the drive wheel depending on the relative position of the rotor relative to the stator. Specifically, the engine RPM and the amount of torque and horsepower the engine is required to produce are the bases for the timing adjustments. These adjustments take place while the engine is in operation. This makes variable valve timing possible because intake and exhaust valve timing is constantly adjusted throughout the RPM range. The performance benefits include the increase of engine efficiency and improvement of idle smoothness. The engine can also deliver more horsepower and torque versus a similar displacement engine with conventional valve timing. This also allows the engine to have improved fuel economy and results in the engine emitting fewer hydrocarbons.

The stator includes webs which protrude radially toward a central axis of the stator. Intermediate spaces are formed between the adjacent webs, and pressure medium is introduced to these spaces via a hydraulic valve. The rotor includes vanes which protrude radially away from the central axis of the rotor, and project between adjacent webs of the stator. These vanes of the rotor subdivide the intermediate spaces between webs of the stator into two pressure chambers (often referred to as "A" and "B", respectively). In order to change the angular position between the camshaft and the drive wheel, the rotor is rotated relative to stator. For this purpose, depending on the desired direction of rotation each time, the pressure medium in every other pressure chamber ("A" or "B") is pressurized, while the other pressure chambers ("B" or "A") are relieved of pressure toward the tank.

During some operating states of the internal combustion engine, it becomes imperative to lock the position of the rotor relative to the stator. For this purpose, a valve timing control apparatus in the form of a lock pin may be utilized on the rotor for locking into a corresponding bore which is provided in the stator.

The locking pin of many cam phase locking systems provides that the locking pin is held in the unlocked position by the pressure of one chamber. If a stepped locking pin is utilized, pressure might also conic from both chambers because the "step" of the stepped locking pin separates both chambers from each other.

Typical problems that occur in a cam phase locking system include, but are not limited to:

- failure to lock or inefficient locking when the pressure medium is cold;
- residual pressure in the retard and/or advance chamber (due to torque reversals of the camshaft (possibly caused by spring forces of the gas exchange valves)) tends to unlock the pin, especially when the engine-ignition is switched off but the crankshaft still rotates;
- failure to lock or inefficient locking when the engine is turned off; and
- when pressure medium gets hot sometimes it leaks, causing the pump to deliver less pressure, which influences the cam phasers as well as the operation of the lock pin, wherein there may be a failure to lock or inefficient locking due to low pressure medium pressure.

SUMMARY OF THE INVENTION

The present invention is directed at providing an improved valve timing control device, in effect a cam phaser which provides a centering slot which tends to naturally center and lock. the rotor relative to the stator at desired times relative to the operating state of the engine.

In one example embodiment of the invention, a centering mechanism is provided with regard to the location of the rotor relative to the stator. Specifically, a centering slot is provided on the rotor and/or stator which provides a leak path for pressure medium, from both the retard chambers and the advancement chambers, through a pressure medium control valve. This tends to center and lock the rotor relative to the stator.

As such, the invention provides a fail-safe locking mechanism in the event of an interruption in the control signal (i.e., zero duty cycle or current applied to the actuator).

The invention also provides for a low part count and reduced complexity compared to many other mid-lock cam phased systems.

The present invention also provides for an extended range of authority both advance and retard of the lock position.

The present invention provides for efficient locking when the engine is turned off, even when the pressure medium is cold, or when pressure medium pressure is reduced.

Still further, the present invention provides that the locking pin does not tend to become unlocked as a result of residual pressure being contained in the retard and/or advance chamber.

Additional advantages of the invention ma be derived from the patent claims, the description and the drawings.

BRIEF DESCRIPTION OF THE DRAWINGS

The present invention will hereinafter be described in conjunction with the appended drawing figures, wherein like reference numerals denote like elements, and.

DETAILED DESCRIPTION

Figure 1:
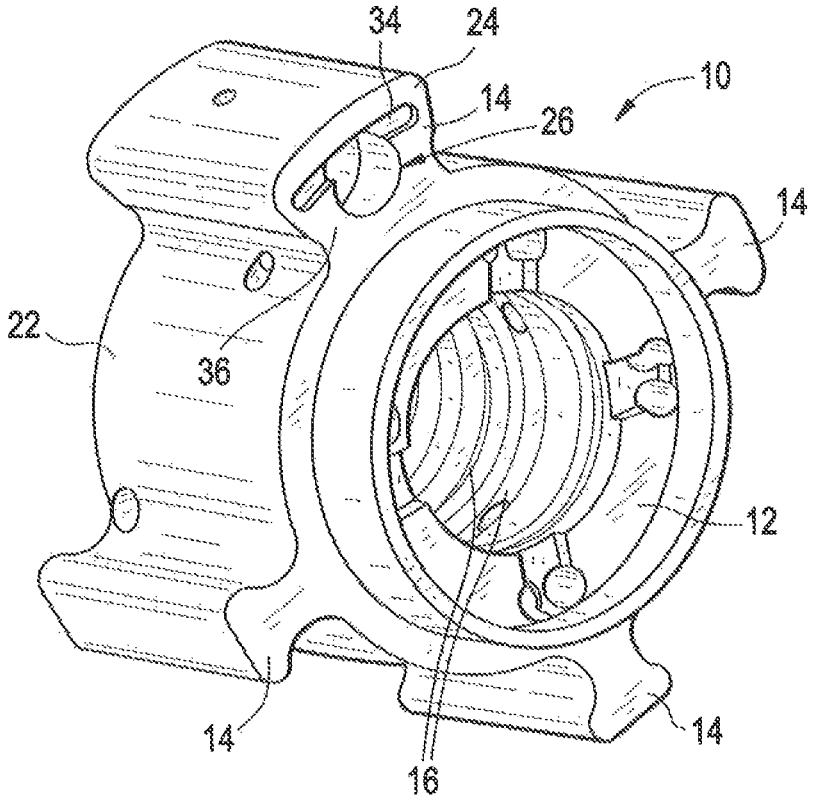
FIG. 1 is a perspective view of a rotor component of a valve timing control device which is in accordance with an embodiment of the present invention.

While this invention may be susceptible to embodiment in different forms, there is shown in the drawings and will be described herein in detail, specific embodiments with the understanding that the present disclosure is to be considered an exemplification of the principles of the invention, and is not intended to limit the invention to that as illustrated.

An embodiment of the present invention provides a valve timing control device, in effect a cam phases, for use with an internal combustion engine.

As shown in FIG. 1, one of the components of the valve timing control device comprises a rotor 10. The rotor 10 includes a hub 12, as well as vanes 14 which protrude radially away from the hub 12. The rotor 10 also includes annular channels 16 which communicate with additional channels 18, 20 (see FIG. 3) which lead to the outside surface 22 of the rotor 10. As will be described, these channels 16, 18, 20 provide fluid paths for pressure medium.

The rotor 10 also includes, in one (24) of its vanes 14, a pressure medium control valve chamber 26. As shown in FIGS. 4-8, a pressure medium control valve 28 is disposed in this chamber 26, and the rotor 10 provides at least one internal fluid channel 30 which leads to this chamber 26 and which communicates with at least one of the annular channels 16 provided in the hub 12 of the rotor 10. As such, pressure medium can flow back and forth between the pressure medium control valve 28 and a hydraulic valve 32 (shown in FIG. 4).

As shown in FIG. 1, proximate the pressure medium control valve chamber 26, and in fluid communication therewith, is a centering slot 34 formed on the external surface 36 of the vane 24 of the rotor 10. As will be described more fully later herein, this centering slot 34 works to provide that pressure medium can move along the centering slot 34 to the pressure medium control valve 28 when the rotor 10 is in certain positions relative to the stator 10, during certain stages of operation of the engine.

Preferably, the rotor 10 has no sealing on its outside instead, preferably sealing is effected by the length of the vanes (i.e., sealing length). Preferably, there is no sealing because if a slot had to be provided for a seal on the radial outside of the vane, this would reduce the available space for the pressure medium control valve chamber 26. That being said, sealing can be provided while still staying very much within the scope of the present invention.

Figure 2:
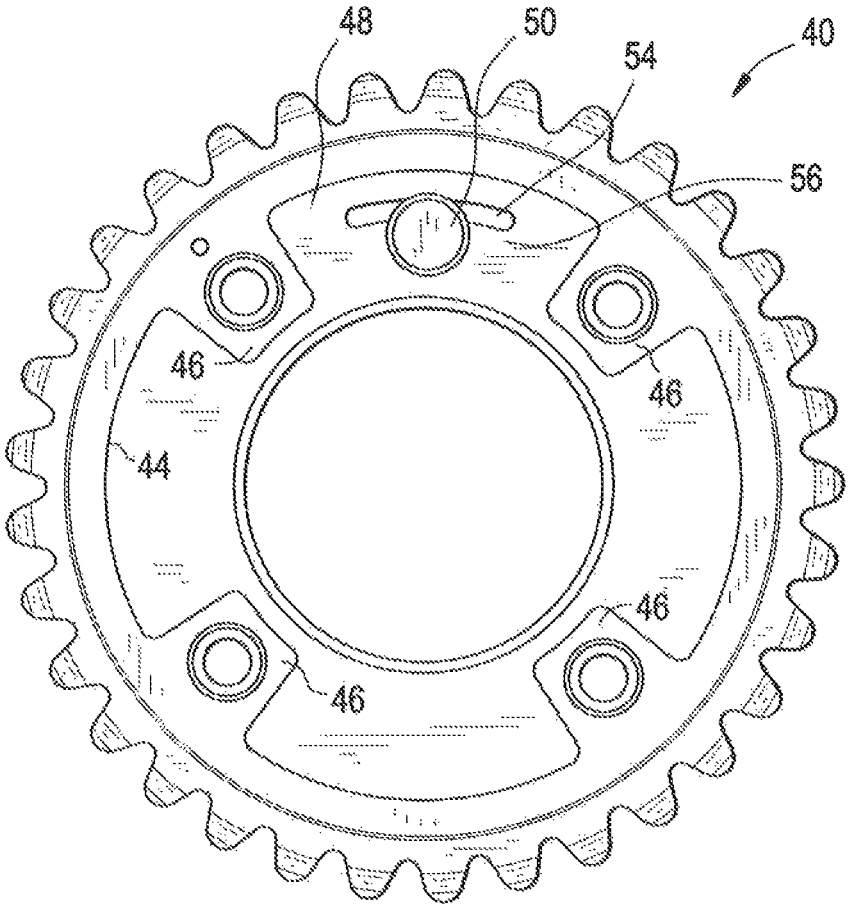
FIG. 2 is a front view of a stator component of the valve timing control device.
Figure 3:
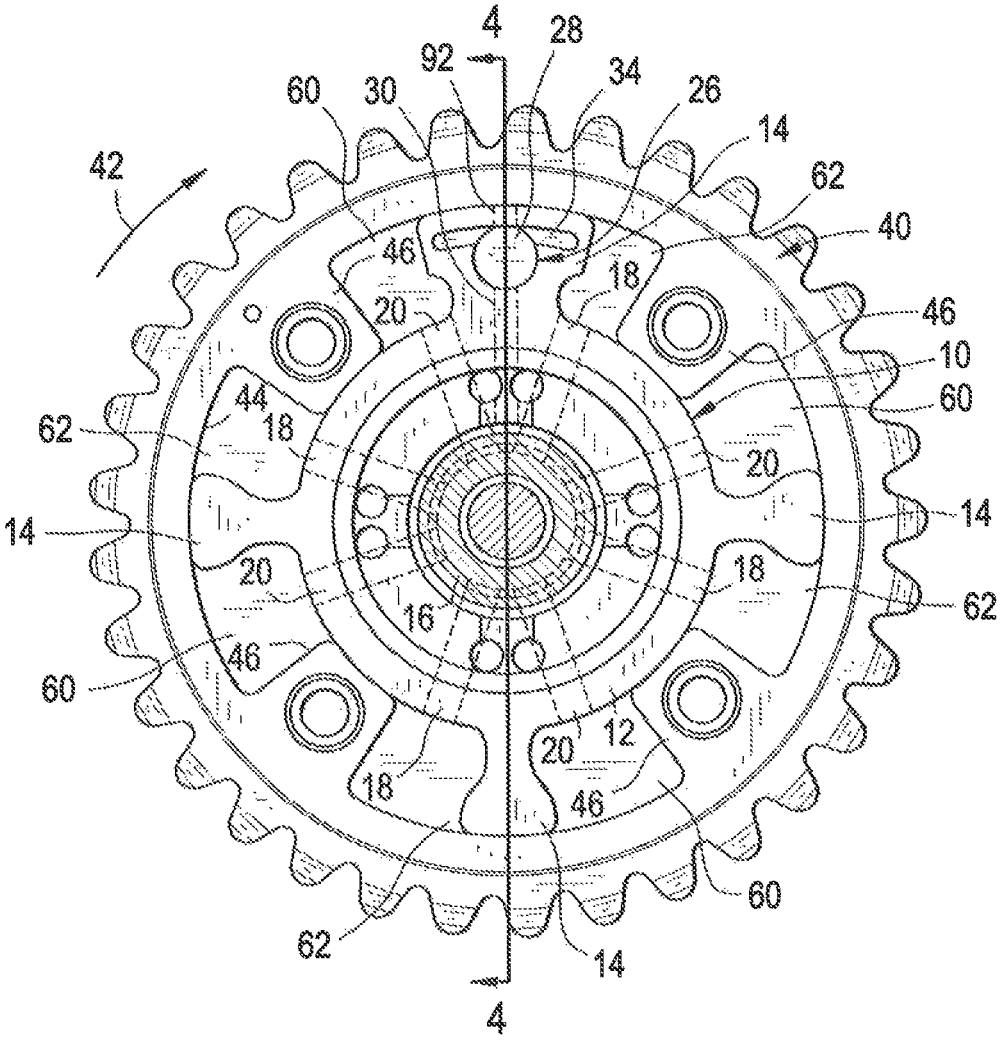
FIG. 3 shows the rotor and stator engaged with each other.

As shown in FIG. 2, another component of the valve timing control device comprises a stator 40. The stator 40 is drive-connected to a crankshaft (not shown) by means of a drive element (also not shown). This is represented in FIG. 3 using arrow 42. The stator 40 comprises a cylindrical stator base 44, and webs 46 protrude from the base 44, radially toward the inside. The webs 46 are spaced apart, and in one of these spaces 48, between two of the webs 46, is a lock pin bore 50 configured to receive a lock pin 52 (shown in FIGS. 4-8) of the pressure medium control valve 28, thereby locking the position of the rotor 10 relative to the stator 40 (see FIGS. 4, 5 and 8).

As shown in FIG. 2, preferably a centering slot 54 is also formed in an external surface 56 of the stator 40, proximate the lock pin bore 50. As will be described more fully later herein, this centering slot 54 works to provide that pressure medium can move along the centering slot 54 in the stator 10, to the centering slot 34 on the rotor 10, and to the pressure medium control valve chamber 26, when the rotor 10 is in certain positions relative to the stator 40, during certain stages of operation of the engine.

Either one or both of the rotor 10 and stator 40 may be sintered, during which time the slots 34, 54 become formed. While FIGS. 1 and 2 depict a centering slot 34, 54 being provided on each of the rotor 10 and the stator 40, it is possible while still staying well within the scope of the present invention to provide a centering slot on only one of these components, such as the stator 40, and/or to provide fluid channels which look completely different from the centering slots 34, 54 which are depicted herein, so long as some form of fluid path is provided from the pressure chambers 60, 62 existing between the vanes 14 and webs 46, to the pressure medium control valve chamber 26.

Additionally, while the term "centering" is used herein, it must be appreciated that the lock pin bore 50 need not be (and most likely would not be) provided exactly between two adjacent webs 46 of the stator 10; however, it is preferred that the lock pin bore 50 be provided at some intermediate position between the fully retarded and fully advanced positions of the rotor 10.

FIG. 3 shows the rotor 10 engaged with the stator 40. Specifically, the rotor 10 and stator 40 and engaged with each other such that the centering slots 34, 54 face each other the external surface 36 of the rotor 10 faces the exterior surface 56 of the stator 40. As shown in FIG. 3, the rotor 10 and stator 40 are coaxial relative to each other, and each of the vanes 14 of the rotor 10 is disposed between two adjacent webs 46 of the stator 10. As such, pressure chambers 60, 62 are provided between each vane 14 and web 46. The rotor 10 provides at least one fluid path to each pressure chamber 60, 62, such that pressure medium can flow back and forth between each pressure chamber 60, 62 and a hydraulic cylinder 32 (see FIG. 4). More specifically, the internal channels 16, 18, 20 of the rotor 10 are configured such that there are two sets of pressure chambers 60, 62 disposed between the vanes 14 of the rotor 10 and the webs 46 of the stator 40, wherein every other chamber 60 is a retard pressure channel, and the remaining pressure chambers 62 are advancement pressure channels. During operation, providing more pressure medium pressure in the advancement chambers 62 than the retard chambers 60 causes the rotor 10 to move clockwise relative to the stator 10. In this case, pressure medium from the compressed retard chambers 60 will be drained to the tank T (as indicated by arrows 70 in FIG. 4). On the other hand, providing more pressure medium pressure in the retard chambers 60 than the advancement chambers 62 causes the rotor 10 to move counter-clockwise relative to the stator 40. In this case, pressure medium from the compressed advancement chambers 62 will be drained to the tank T (as indicated by arrows 70 in FIG. 4).

Figure 4:
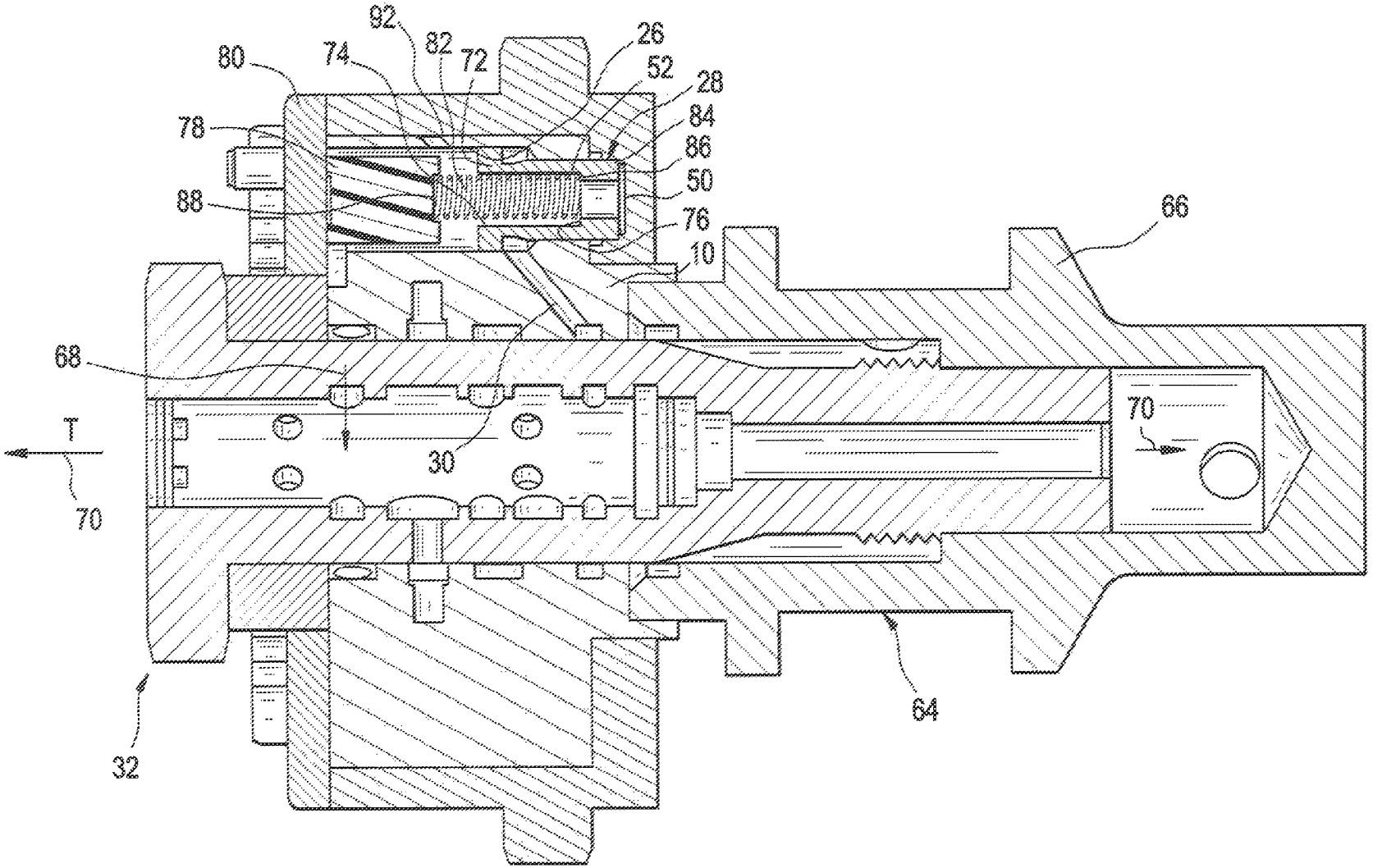
FIG. 4 is a cross-sectional view taken along line 4-4 of FIG. 3, showing an pressure medium control valve component of the valve timing control device, as well as a camshaft and a hydraulic valve.

FIG. 4 is a cross-sectional view taken along line 4-4 of FIG. 3. As shown, the rotor 10 is joined to a camshaft 64 in a torsionally rigid manner. The camshaft 64 includes one or more cam lobes 66 (one of which is shown in FIG. 4) which are configured to push against gas exchange valves (not shown) in order to open them. A hydraulic valve 32 is disposed within the camshaft 64, proximate the rotor 10. The hydraulic valve 32 is conventional and, therefore, is shown just generally in FIG. 4, in the form of a single piece. The hydraulic valve 32 is controlled via electronics to effectively provide for the controlled flow of pressure medium, in order to control the camshaft 64. More specifically, a pump (not shown) works to supply pressure medium to the hydraulic valve (as indicated by arrow 68 in FIG. 4), and the hydraulic valve drains to the tank T.

The pressure medium control valve 28 will now be described in more detail with reference to FIG. 4. As shown, the pressure medium control valve 28 includes a lock pin 52, Preferably, the lock pin 52 is generally cylindrical, is generally non-stepped, but has a head 72. The lock pin 52 also includes a throughbore 74 having an internal shoulder 76. As will be described more fully later herein, the throughbore provides that pressure medium can flow through the lock pin 52.

The pressure medium control valve 28 also includes a cap 78 which abuts a cover 80 which is fixed to the stator 40, as well as a biasing member, such as a compression spring 82, which is configured to engage the lock pin 52 and push the lock pin 52 into engagement with the lock pin bore 50 in the stator 40 (see FIGS. 4, 5 and 8), such that the position of the rotor 10 become effectively locked with regard to the stator 40. Preferably, the portion 84 of the lock pin 52 which engages in the lock pin bore 50 has a cylindrical outer surface as opposed to being tapered; however, a tapered lock pin can be used while still staying well within the scope of the present invention. Regardless, while one end 86 of the compression spring 82 engages the internal shoulder 76 of the lock pin 52, the other end 88 of the compression spring 82 engages the cap 78. While the end 86 of the compression spring 82 is shown as engaging an internal shoulder 76 in the lock pin 52, this end 86 of the compression spring 82 may engage a rear surface of the lock pin 52, with the other end 88 of the compression spring 82 engaging in a recess provided in the cap 78. The compression spring 82 can be implemented in many ways while still staying very much within the scope of the present invention. In fact, while the biasing member is depicted in FIGS. 4-8 as being a compression spring 82, the biasing member may take other forms so long as the lock pin 52 is urged toward the lock pin bore 50 which is provided in the stator 40.

As shown in FIGS. 4-8, the rotor 10 provides at least one fluid channel 30 which leads to the pressure medium control valve chamber 26. As such, pressure medium can flow back and forth between the hydraulic valve 32 (see FIG. 4) and the pressure medium control valve chamber 26, through the rotor 10, along at least one of the annular channels 16. Additionally, the rotor 10 provides at least one additional channel 92 which is configured to provide that pressure medium can vent from the pressure medium control valve chamber 26 to the crankcase. Also, the flow from the hydraulic valve 32 leads to tank T which is established by the crankcase. At times, as will be described in more detail hereinbelow, the pressure medium pushes on the head 72 of the lock pin 52 in order to overcome the force of the compression spring 82, such that the lock pin 52 withdraws and unseats from the lock pin bore 50, thereby freeing the rotor 10 from the stator 40 such that the rotor 10 can pivot relative to the stator 40.

The operation of the pressure medium control valve 28 and the flow of pressure medium during certain stages of operation of the engine will now be described with reference to FIGS. 5-11.

Figure 5:
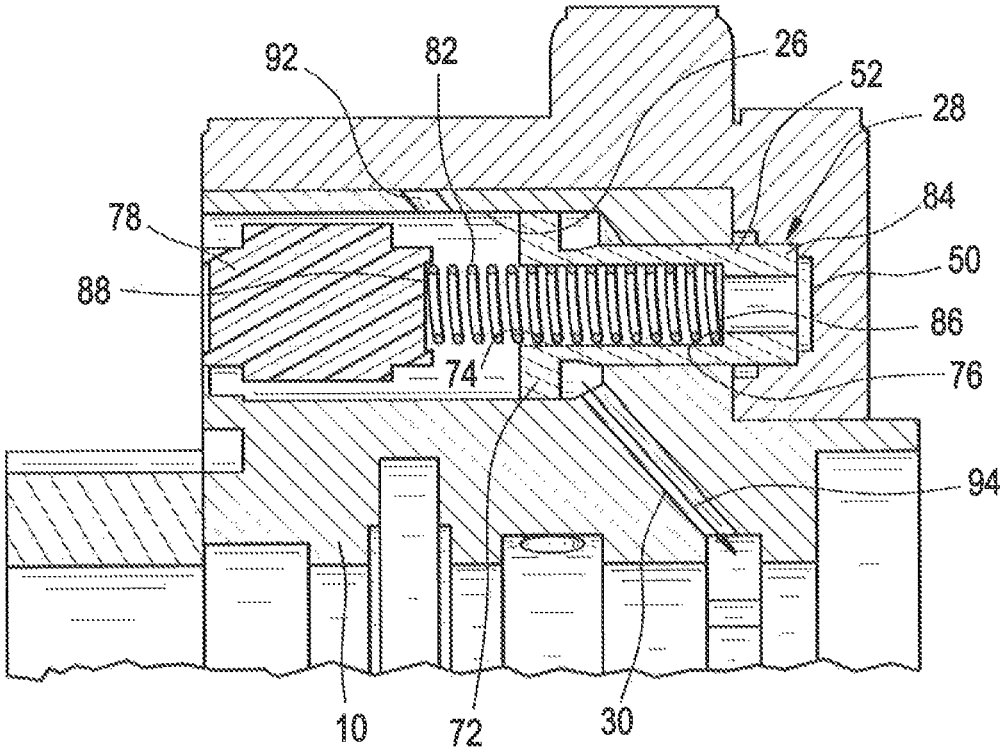
FIGS. 5-8 show the pressure medium control valve in various states, during various stages of operation of the engine.
Figure 9:
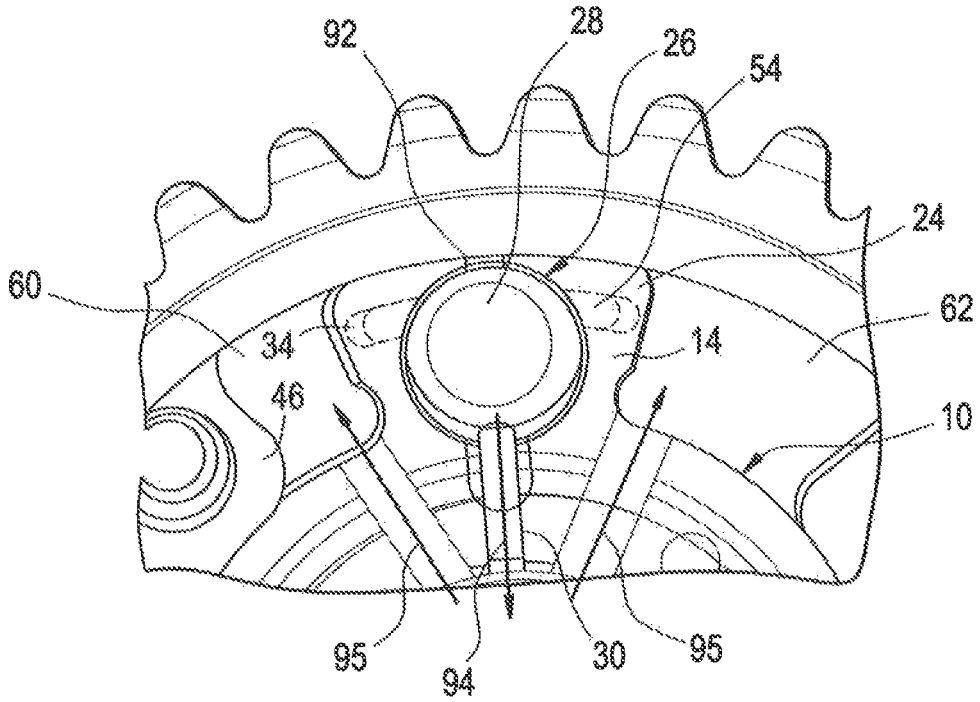
FIG. 9 shows an orientation of the rotor relative to the stator during which point in time a centering slot is blocked off.

FIG. 5 shows the state of the pressure medium control valve 28 during engine start. As shown, the pressure medium control valve 28 is at a deactivated position, during which time the compression spring 82 pushes the lock pin 52 into engagement with the lock pin bore 50 of the stator 10. At this time, pressure medium can vent from the pressure medium control valve chamber 26 (as indicated by arrow 94 in both FIGS. 5 and 9), to the hydraulic valve 32 (see FIG. 4). Additionally, as shown in FIG. 9, pressure medium throttles to both the advancement and retarded chambers 60, 62 (i.e., to both sides of each vane 14) (as indicated by arrows 95 in FIG. 9), while the centering slot 54 on the stator 40 is closed off to the pressure chambers 60, 62 as a result of the position of the rotor 10 being such that the vane 24 of the rotor 10 covers the centering slot 54 on the stator 40.

Figure 6:
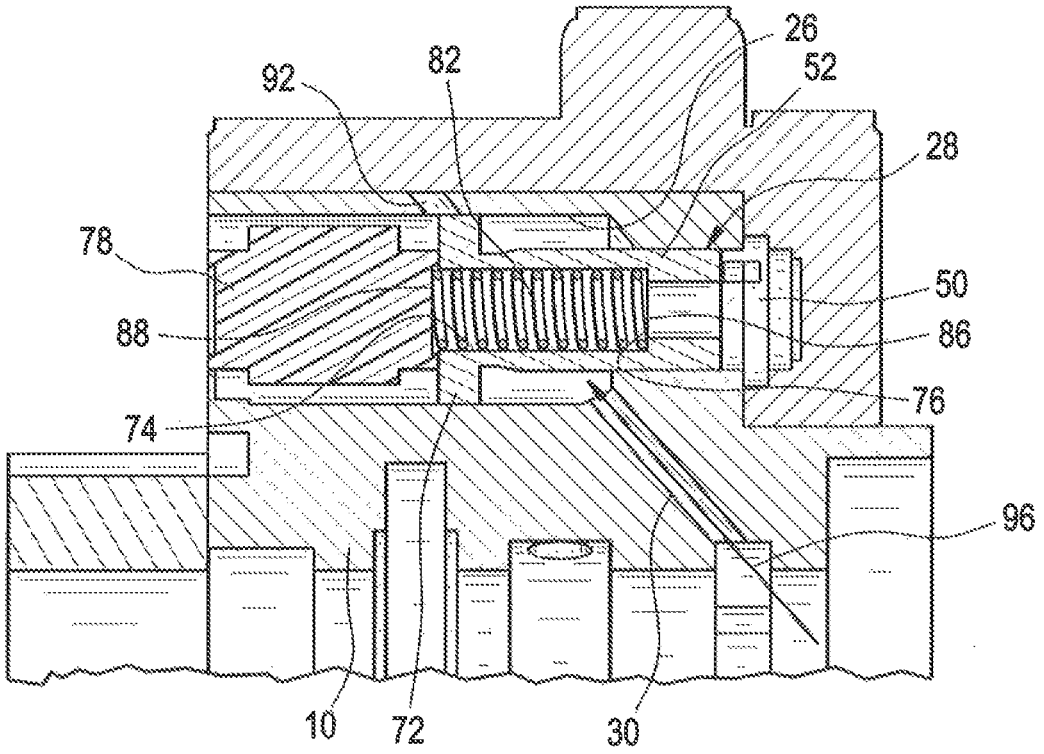
Figure 7:
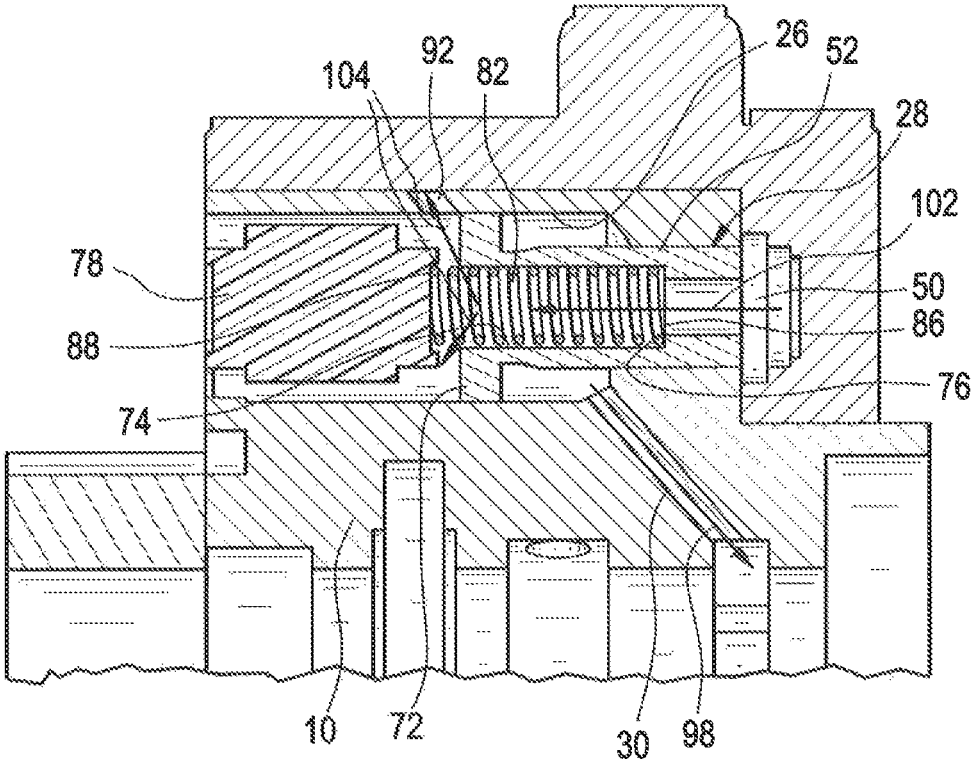
Figure 10:
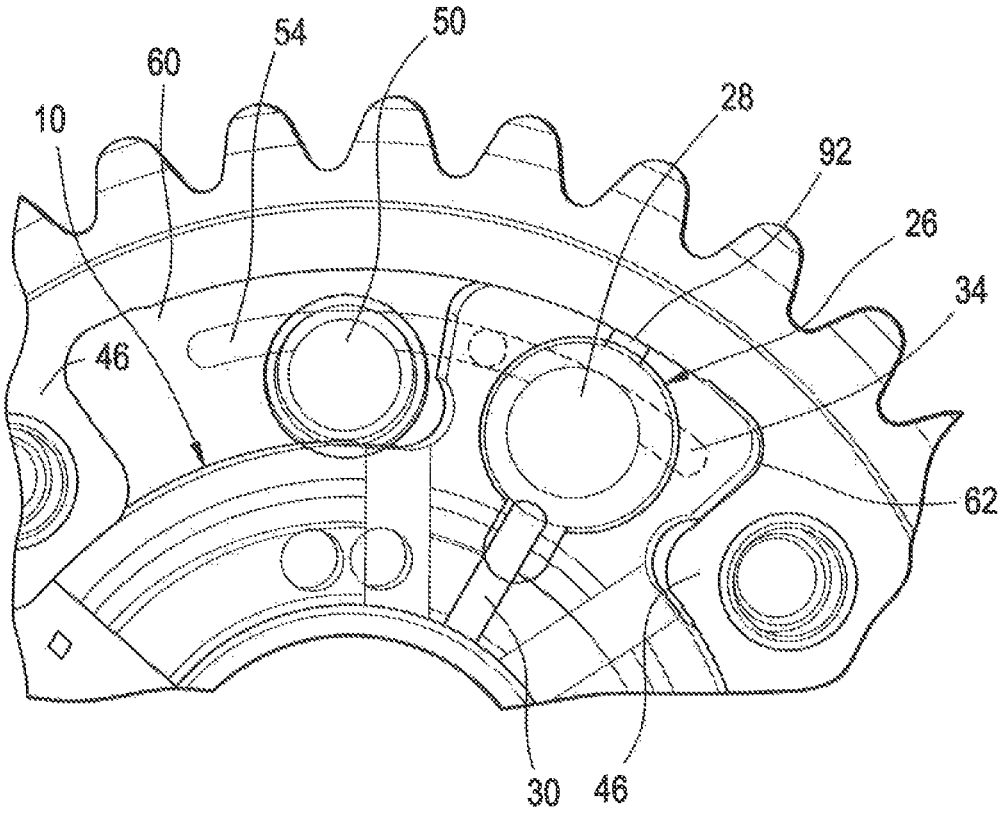
FIGS. 10 and 11 shows orientations of the rotor relative to the stator during which point in time the centering slot is accessible.
Figure 11:
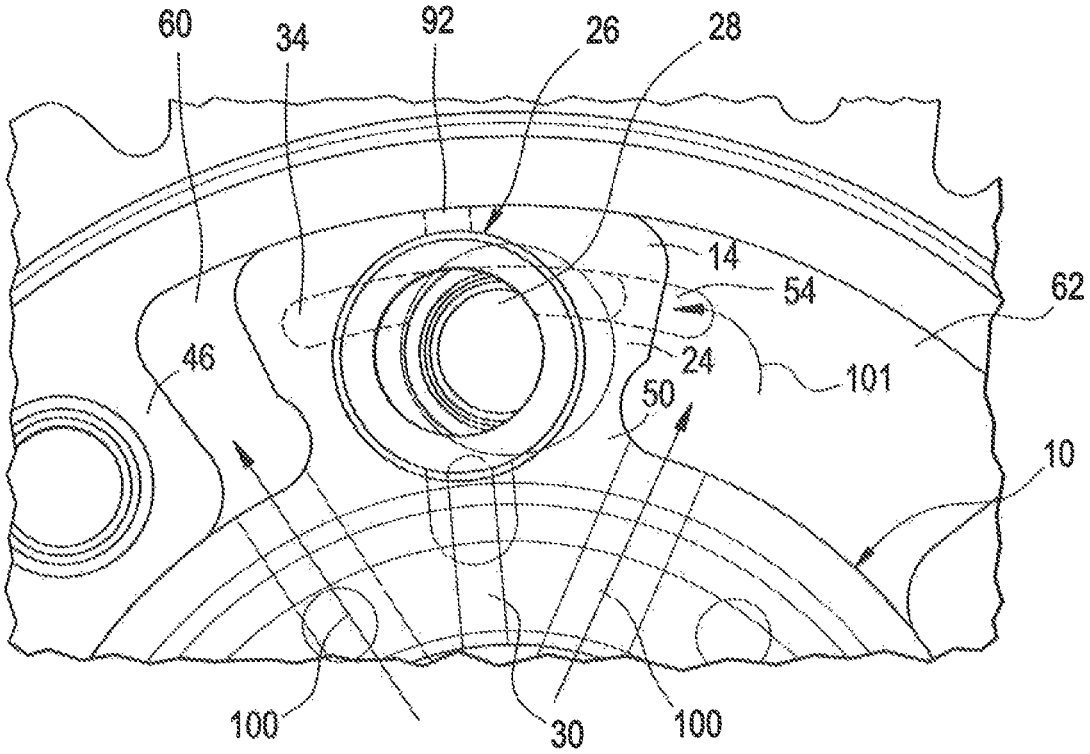

FIG. 6 shows the state of the pressure medium control valve 28 while the engine is running. As shown, pressure medium is provided to the pressure medium control valve chamber 26 (as indicated by arrow 96), from the hydraulic valve 32 (see FIG. 4) such that the biasing force of the compression spring 82 is overcome, and the lock pin 52 is pushed out of engagement with the lock pin bore 50 in the stator 40. The lock pin 52 is moved into seated contact with the cap 78, which provides that pressure medium cannot vent through the rotor 10 (i.e., through channel(s) 92 to the crankcase). During this time, the rotor 10 becomes effectively unlocked from the stator 40 and is free to pivot relative to the stator 40, as shown in. FIG. 10, FIG. 7 shows the state of the pressure medium control valve 28 during engine shutdown. As shown, during engine shutdown, the pressure medium control valve 28 moves toward its deactivated position. Pressure medium vents from the pressure medium control valve chamber 26 through channel 30 in the rotor 10 (as indicated by arrow 98), to the hydraulic valve 32 (see FIG. 4), and the compression spring 82 tends to push the lock pin 52 causing the lock pin 52 to unseat from the cap 78, thereby opening a leak path. As shown in FIG. 11, as the rotor 10 pivots relative to the stator 40, not only does pressure medium throttle to the pressure chambers 60, 62 (as indicated by arrows 100 in FIG. 11), but the centering slot 54 in the stator 40 becomes accessible to the pressure medium in the pressure chambers 60, 62. This creates a low pressure area that drives the rotor 10 to a position such that the lock pin 52 becomes aligned with the lock pin bore 50. As the rotor 10 is moving such that the lock pin 52 ultimately becomes aligned with the lock pin bore 50, the pressure medium in the pressure chambers 60, 62 can vent along the centering slot 54 provided in the stator 40 (as indicated by arrow 101 in FIG. 11), along the centering slot 34 provided in the rotor 10, to the pressure medium control valve chamber 26 (as indicated by arrow 102 in Figure), through the throughbore 74 in the lock pin 52, past the cap 78 (as indicated by arrows 104), out the channel(s) 92 provided in the rotor 10, to the crankcase.

Figure 8:
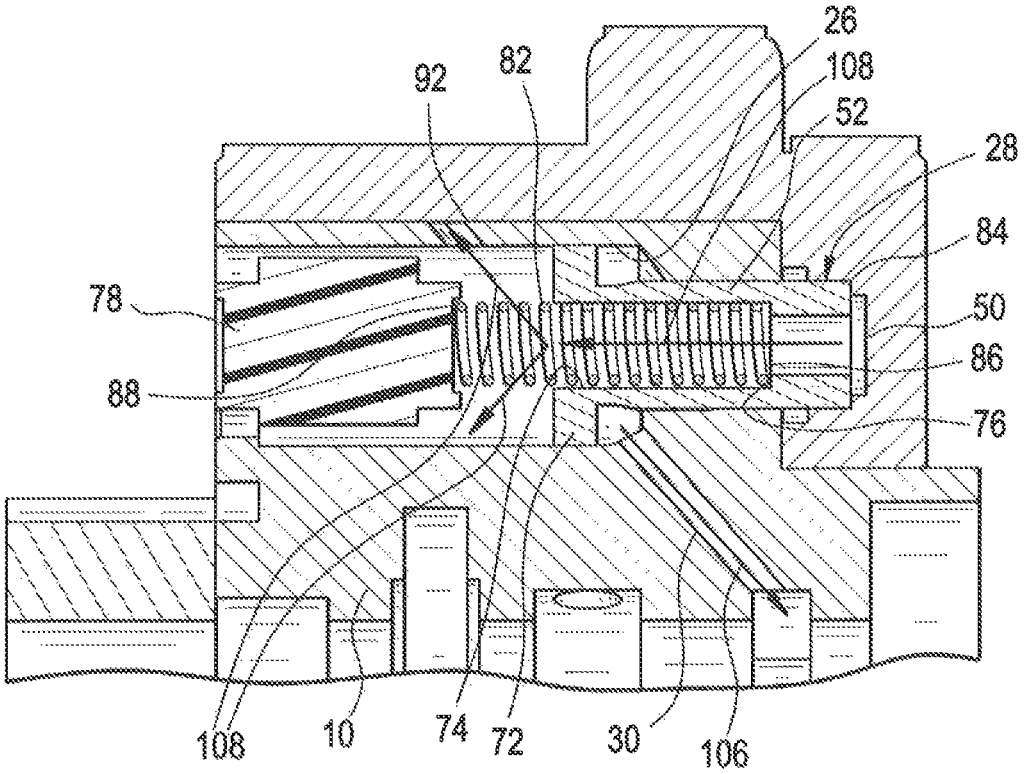

As shown in FIG. 8, at some point after engine shutdown, the lock pin 52 becomes aligned with the lock pin bore 50 and seats therein. During this time, any pressure medium remaining in the pressure medium control valve chamber 26 can vent through the channels 30, 92 in the rotor 10 (both to the hydraulic valve 32 (said fluid flow being indicated by arrow 106 in FIG. 8 and by arrow 94 in FIG. 9) and to the crankcase (said fluid flow being indicated by arrow 108 in FIG. 8)). At this time, as shown in FIG. 9, the rotor 10 is positioned relative to the stator 40 such that the centering slot 54 in the stator 40 is covered by the position of the rotor 10. As such, the pressure chambers 60, 62 cannot vent through the centering slots 34, 54, and pressure medium throttles to the pressure chambers 60, 62 (as indicated by arrows 5 in FIG. 9).

While the centering slots 34, 54 are inaccessible to the pressure chambers 60, 62 when the position of the rotor 10 is locked relative to the stator 40 via the lock pin 52 (or when the lock pin 52 is at least generally aligned with the lock pin bore 50), as shown in FIG. 10 preferably the centering slots 34, 54 on the rotor 10 and stator 40 are configured such that they are in fluid communication with each other when the rotor 10 is at either the fully advanced or fully retarded position.

Figure 12:
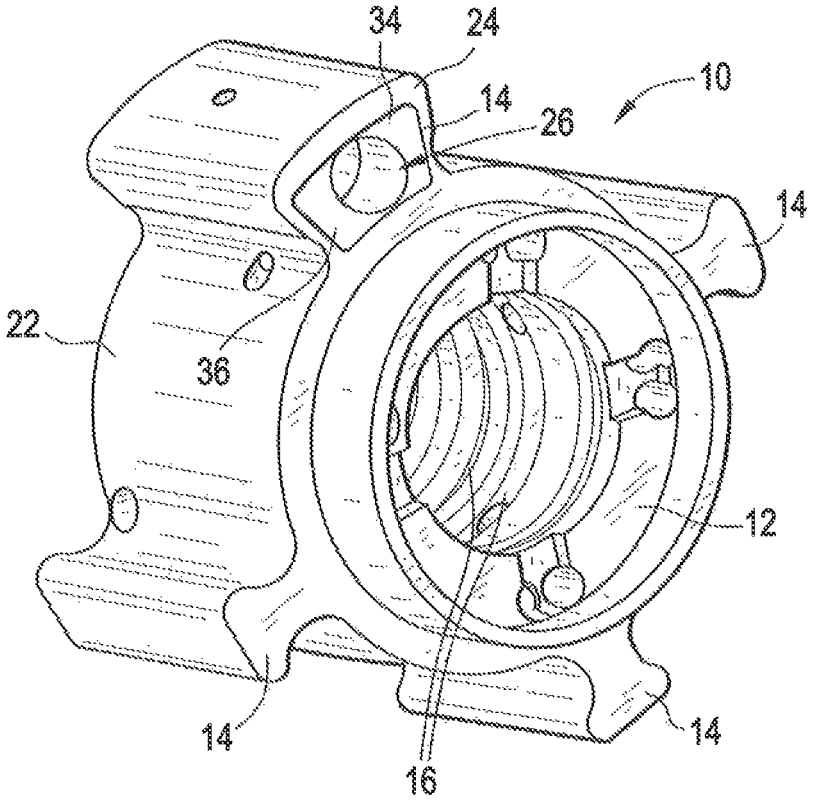
FIG. 12 shows an alternative rotor having a larger slot (i.e., fluid path)
Figure 13:
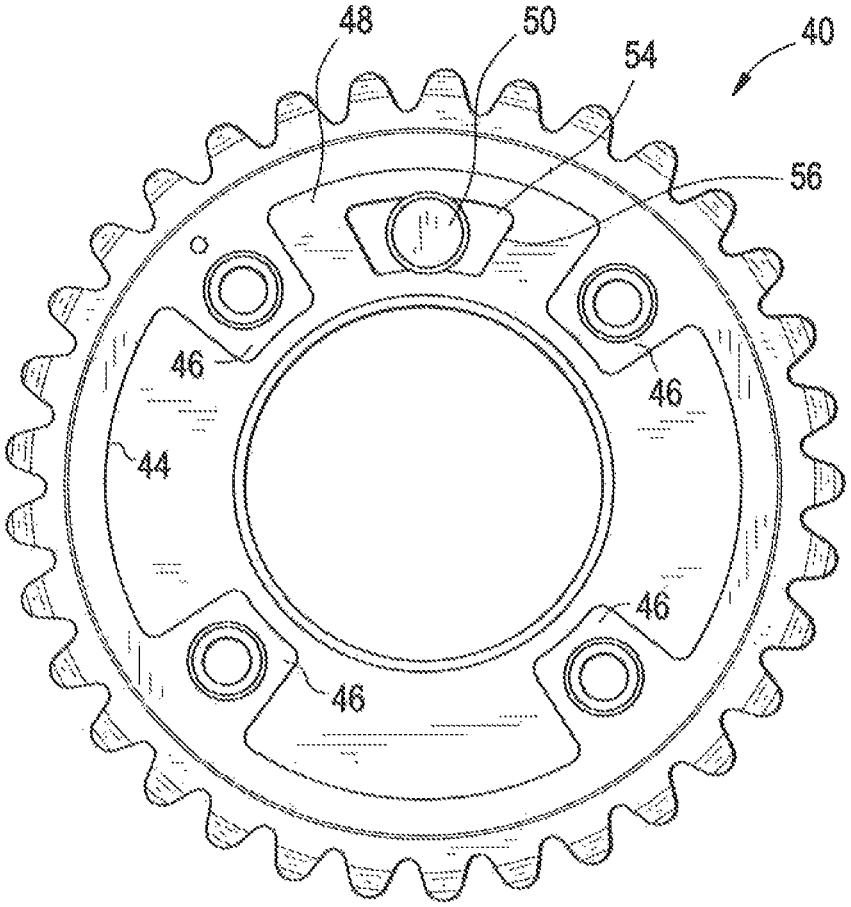
FIG. 13 shows an alternative stator having a larger slot (i.e., fluid path)
Figure 14:
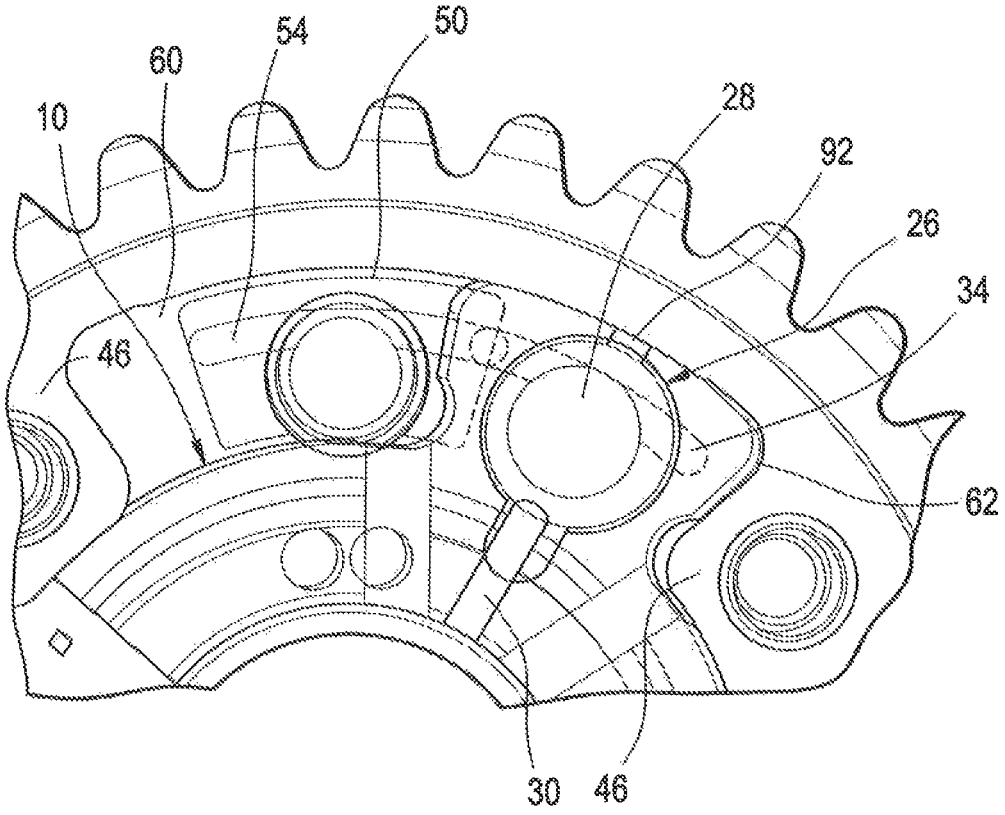
FIG. 14 shows the stator of FIG. 13 being used with the rotor of FIG. 1.

The slots 34, 54 on the rotor 10 and stator 40 are depicted in FIGS. 1 and 2 as being relatively narrow, generally linear recesses provided on the external surfaces 36,56 of the rotor 10 and stator 40 these fluid paths can take many other forms. For example, FIG. 12 shows where the slot 34 is provided as being much bigger on the rotor 10, while FIG. 13 shows where the slot 54 is provided as being much bigger on the stator 40. FIG. 14 shows an example where a large slot 34 is provided on the stator 40, but a smaller slot 54 is provided on the rotor 10. As discussed, the fluid path leading away from the pressure chambers 60, 62 can take many forms.

The present invention, by providing a mechanism which tends, during certain operation states of the engine, to cause the rotor 10 to move to a position such that lock pin 52 becomes aligned with the lock pin bore 50 in the stator 40, provides several benefits. Additional benefits are provided as a result of the lock pin 52 being part of a pressure medium control valve 28 through which pressure medium can vent from the pressure chambers 60, 62, during certain stages of engine operation. Many of these benefits have been discussed hereinabove.

The described embodiments only involve exemplary configurations. A combination of the features described for different embodiments is also possible. Additional features, particularly those which have not been described, for the device parts belonging to the invention can be derived from the geometries of the device parts shown in the drawings.

While specific embodiments of the invention has been shown and described, it is envisioned that those skilled in the art may devise various modifications without departing from the spirit and scope of the present invention.

What is claimed is:

1. A valve timing control device for an internal combustion engine, said valve timing control device comprising:

a rotor connected to a camshaft, said rotor comprising a plurality of vanes;

a stator engaged with the rotor, said stator comprising a plurality of webs, wherein at least one of said rotor and said stator comprises a centering slot, and wherein advance and retard chambers are provided between each of the webs and vanes;

a pressure medium control valve disposed in one of said vanes of said rotor, wherein said pressure medium control valve is configured to selectively lock and unlock a position of said rotor relative to said stator, wherein the valve timing control device is configured such that both the advance and retard chambers are ventable through said centering slot and thereafter through said pressure medium control valve, depending on the position of the rotor, wherein when the pressure medium control valve is locked, the centering slot is inaccessible to the chambers.

2. The valve timing control device as recited in claim 1, wherein the centering slot is provided on both the rotor and the stator.

3. The valve timing control device as recited in claim 1, wherein the rotor is configured such that it is positionable to render the centering slot inaccessible to the chambers.

4. The valve timing control device as recited in claim 1, wherein the rotor is configured such that it is positionable to at least partially cover the centering slot on the stator.

5. The valve timing control device as recited in claim 1, wherein the rotor is configured such that it is positionable to fully cover the centering slot on the stator.

6. The valve timing control device as recited in claim 1, wherein the pressure medium control valve comprises a lock pin, and a biasing member which urges the lock pin toward the stator.

7. The valve timing control device as recited in claim 1, wherein the pressure medium control valve comprises a lock pin, wherein the lock pin is configured to provide a pressure medium fluid path through the lock pin.

8. The valve timing control device as recited in claim 1, wherein the pressure medium control valve comprises a lock pin, wherein a portion of the lock pin engages the stator, wherein said portion is cylindrical.

9. The valve timing control device as recited in claim 1, wherein the pressure medium control valve comprises a hydraulic cylinder and a lock pin, wherein the rotor is configured to provide a pressure medium fluid path from the hydraulic cylinder to the lock pin, wherein the lock pin is shiftable to open and close said pressure medium fluid path.

10. The valve timing control device as recited in claim 1, wherein the pressure medium control valve comprises a lock pin, wherein the lock pin is unstopped but comprises a head.

11. The valve timing control device as recited in claim 1, wherein the pressure medium control valve is disposed in a pressure medium control valve chamber in said at least one vane of said rotor, wherein the centering slot is provided on a surface of said at least one vane of the rotor, proximate the pressure medium control valve chamber.

12. The valve timing control device as recited in claim 1, wherein the stator comprises a lock pin bore, wherein the pressure medium control valve comprises a lock pin which engages the lock pin bore and locks the rotor relative to the stator, and the centering slot is provided on a surface of said stator, in communication with the lock pin bore.

13. The valve timing control device as recited in claim 1, wherein the valve timing control device further comprises a hydraulic valve and a lock pin, wherein the pressure medium control valve is configured to exist in a state wherein the lock pin of the pressure medium control valve engages the stator and locks a position of the rotor relative to the stator, pressure medium is ventable from the pressure medium control valve out the rotor to the hydraulic valve, pressure medium throttles to the chambers, and the rotor is positioned such that the centering slot is inaccessible to the chambers.

14. The valve timing control device as recited in claim 1, wherein the valve timing control device further comprises a hydraulic valve and a lock pin, wherein the valve timing control device is configured to exist in a state wherein pressure medium from the hydraulic valve disengages the lock pin of the pressure medium control valve from the stator, and the pressure medium control valve is configured to prevent pressure medium from venting from the pressure medium control valve to the hydraulic valve.

15. The valve timing control device as recited in claim 1, wherein the valve timing control device further comprises a lock pin, wherein the valve timing control device is configured to exist in a state wherein the lock pin of the pressure medium control valve is disengaged from the stator, thereby providing that the rotor is moveable relative to the stator, wherein the rotor is positioned such that the centering slot is accessible to at least one the chambers, and the pressure medium control valve is configured such that pressure medium is ventable from said at least one chamber, along the centering slot, into the pressure medium control valve, and out the rotor.

16. The valve timing control device as recited in claim 1, wherein the valve timing control device further comprises a hydraulic valve and a lock pin, wherein the pressure medium control valve is configured to exist in a state wherein the lock pin of the pressure medium control valve engages the stator, thereby locks a position of the rotor relative to the stator, the pressure medium control valve is configured such that pressure medium is ventable from the pressure medium control valve to the hydraulic valve, pressure medium throttles to the chambers, and the rotor is positioned such that the centering slot is inaccessible to the chambers.

17. The valve timing control device as recited in claim 1, wherein the valve timing control device further comprises a hydraulic valve and a lock pin, wherein the pressure medium control valve is configured to exist in a first state, a second state, a third state, and a fourth state, wherein:

during the first state, the lock pin of the pressure medium control valve engages the stator and locks a position of the rotor relative to the stator, pressure medium is ventable from the pressure medium control valve out the rotor to the hydraulic valve, pressure medium throttles to the chambers, and the rotor is positioned such that the centering slot is inaccessible to the chambers;

during the second state, pressure medium from the hydraulic valve disengages the lock pin of the pressure medium control valve from the stator, and the pressure medium control valve is configured to prevent pressure medium from venting from the pressure medium control valve to the hydraulic valve;

during the third state, the lock pin of the pressure medium control valve is disengaged from the stator, thereby providing that the rotor is moveable relative to the stator, wherein the rotor is positioned such that the centering slot is accessible to at least one the chambers, and the pressure medium control valve is configured such that pressure medium is ventable from said at least one chamber, along the centering slot, into the pressure medium control valve, and out the rotor; and during the fourth state, the lock pin of the pressure medium control valve engages the stator, thereby locks a position of the rotor relative to the stator, the pressure medium control valve is configured such that pressure medium is ventable from the pressure medium control valve to the hydraulic valve, pressure medium throttles to the chambers, and the rotor is positioned such that the centering slot is inaccessible to the chambers.

18. The valve timing control device as recited in claim 1, wherein the centering slot is disposed in one of the advance chambers when the rotor is in a first position, and is disposed in one of the retard chambers when the rotor is in a second position.

19. The valve timing control device as recited in claim 18, wherein the pressure medium control valve comprises a lock pin which locks the rotor relative to the stator, wherein when the lock pin has the rotor locked relative to the stator, the centering slot is disposed in neither one of the advance and retard chambers.

20. The valve timing control device as recited in claim 1, wherein the pressure medium control valve comprises a lock pin which locks the rotor relative to the stator, wherein pressure control medium from a passageway in the rotor unseats the lock pin while pressure control medium from at least one of the advance and retard chambers vents through the centering slot and thereafter through a throughbore in the lock pin.

* * * * *